US005451917A

United States Patent [19]

Yamamoto et al.

[11] Patent Number: 5,451,917

[45] Date of Patent: Sep. 19, 1995

[54] HIGH-FREQUENCY CHOKE CIRCUIT

[75] Inventors: Osamu Yamamoto; Shinichi Ohmagari; Masakazu Nishida, all of Tokyo, Japan

[73] Assignee: NEC Corporation, Tokyo, Japan

[21] Appl. No.: 360,959

[22] Filed: Dec. 21, 1994

[30] Foreign Application Priority Data

Dec. 24, 1993 [JP] Japan ..... 5-346046

[51] Int. Cl.[6] ..... H01P 1/20

[52] U.S. Cl. ..... 333/246; 333/204

[58] Field of Search ..... 333/103, 204, 246, 263

[56] References Cited

U.S. PATENT DOCUMENTS 3,210,697 10/1965 Comstock ..... 333/246 X
3,259,860 7/1966 Ayer ..... 333/246
5,175,522 12/1992 Clark et al. ..... 333/246

FOREIGN PATENT DOCUMENTS 75903 5/1983 Japan ..... 333/246
4-284002 10/1992 Japan .

*Primary Examiner*—Paul Gensler
*Attorney, Agent, or Firm*—Sughrue, Mion, Zinn, Macpeak & Seas

[57] ABSTRACT

A high-frequency choke circuit comprises a dielectric layer covered with grounding conductors, a lead line of high-impedance and at least one capacitance land formed within the dielectric layer, and at least one through-hole connecting the lead line and the capacitance land. The capacitance lands are disposed closer to the grounding conductors, resulting in large capacitances with small areas. The capacitance lands are formed on a layer distant from the layer on which the lead line is formed. Therefore, unnecessary electromagnetic coupling with other circuits formed on the same layer as the lead line can be reduced. The grounding conductors cover both surfaces of the dielectric layers that incorporate the capacitance lands and the lead line to thereby shield the circuit formed in the dielectric layers electromagnetically from outside.

17 Claims, 6 Drawing Sheets

HIGH-FREQUENCY CHOKE CIRCUIT

BACKGROUND OF THE INVENTION

1. Field of the Invention

The present invention relates to a high-frequency choke circuit and, more specifically, to a high-frequency choke circuit for preventing the passage of high-frequency waves such as microwaves and millimeter waves to ensure isolation between circuits.

2. Prior Art

In microwave and millimeter wave circuits, a high-frequency choke circuit is indispensable for supplying a DC bias to semiconductor devices, for instance. The high-frequency choke circuit is generally comprised of a high-impedance section and a low-impedance section (capacitance section). The capacitance section is an important factor in miniaturization of the entire circuit, in particular, because it requires an increasingly wider area with decreasing frequency.

Various circuit configurations have been proposed to advance miniaturization. The high-frequency choke circuit disclosed in Japanese Patent Laid-open Publication No. Hei. 4-284002 will be described below as an example of such configurations.

FIG. 1 is a schematic sectional view showing a configuration of the conventional high-frequency choke circuit in the above publication. This high-frequency choke circuit is formed in a multilayered substrate. More specifically, a high-impedance line 51 and a first grounding conductor 52 are formed on surface layer P1, a low-impedance line (capacitance land) 53 is formed on second layer P2, and a second grounding conductor 54 is formed on third layer P3. The high-impedance line 51 and the capacitance land 53 are connected in series via a through-hole 55. The capacitance land 53 is interposed between the grounding conductors 52 and 54.

In the above conventional high-frequency choke circuit, input and output lines that are connected to a device such as a GaAs FET and interconnections of a matching circuit, etc., are also formed on surface layer P1. Electromagnetic coupling is thus likely to occur through space, which prevents the choke circuit from having sufficient high-frequency interruption and shielding effects. As a result, an active circuit such as an amplifier circuit cannot operate stably enough.

SUMMARY OF THE INVENTION

An object of the present invention is to provide a high-frequency choke circuit enabling the entire circuit to be miniaturized but having sufficient high-frequency interruption and shielding effects.

According to the invention, a dielectric layer has grounding conductors formed on both surfaces thereof and a lead line formed at the center thereof. Further the dielectric layer has at least one capacitance conductor formed therein with the capacitance conductor disposed closer to the grounding conductor than the lead line and opposed to the grounding conductor to make a capacitor. At least one through-hole is formed in the dielectric layer to connect the lead line and the capacitance conductor.

The lead line is a high-impedance line formed inside the dielectric layer. Since the capacitance conductor is disposed close to the grounding conductor, a large capacitance can be obtained with a small area, resulting in a low-impedance capacitor.

Since the capacitor constituted of the capacitance conductor is distant from the central layer in which the lead line is formed, unnecessary electrical coupling with a circuit formed in the center layer or a layer closer to the center layer can be reduced.

The grounding conductors cover both surfaces of a dielectric layer that incorporates the capacitance conductor and the lead line to thereby shield the circuit formed in the dielectric layer electromagnetically from outside.

DESCRIPTION OF THE PREFERRED EMBODIMENTS

Embodiments of the present invention will be hereinafter described with reference to the accompanying drawings.

Figure 1:
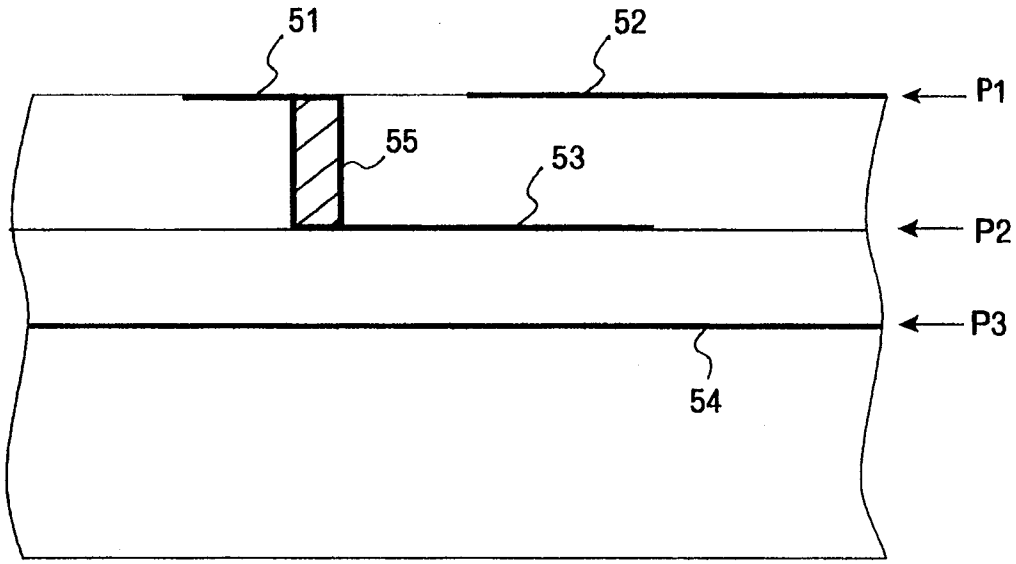
FIG.1 (PRIOR ART)
FIG. 1 is a schematic sectional view of a conventional high-frequency choke circuit.
Figure 2:
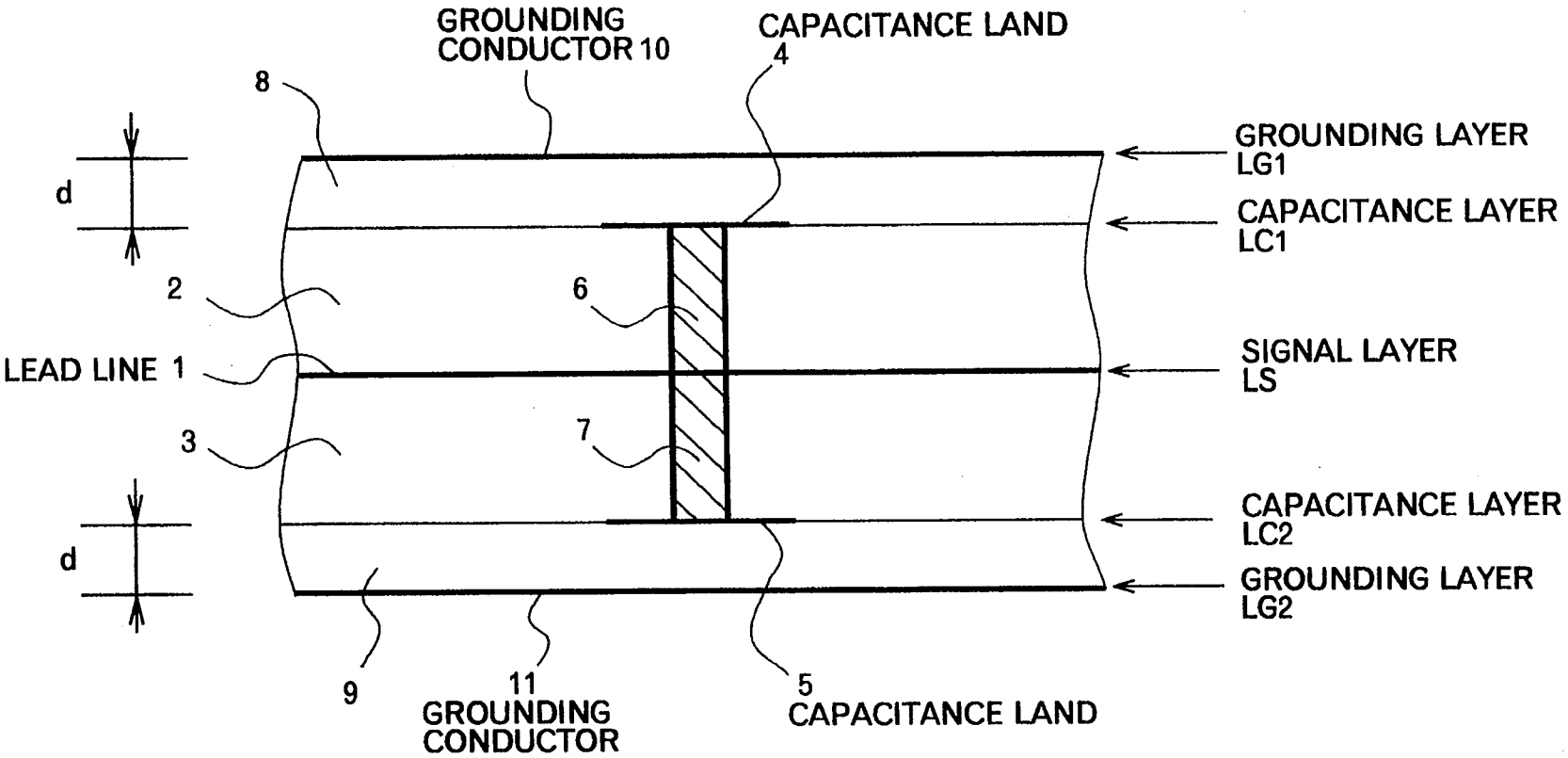
FIG. 2 is a schematic sectional view of a high-frequency choke circuit according to a first embodiment of the present invention.
Figure 3:
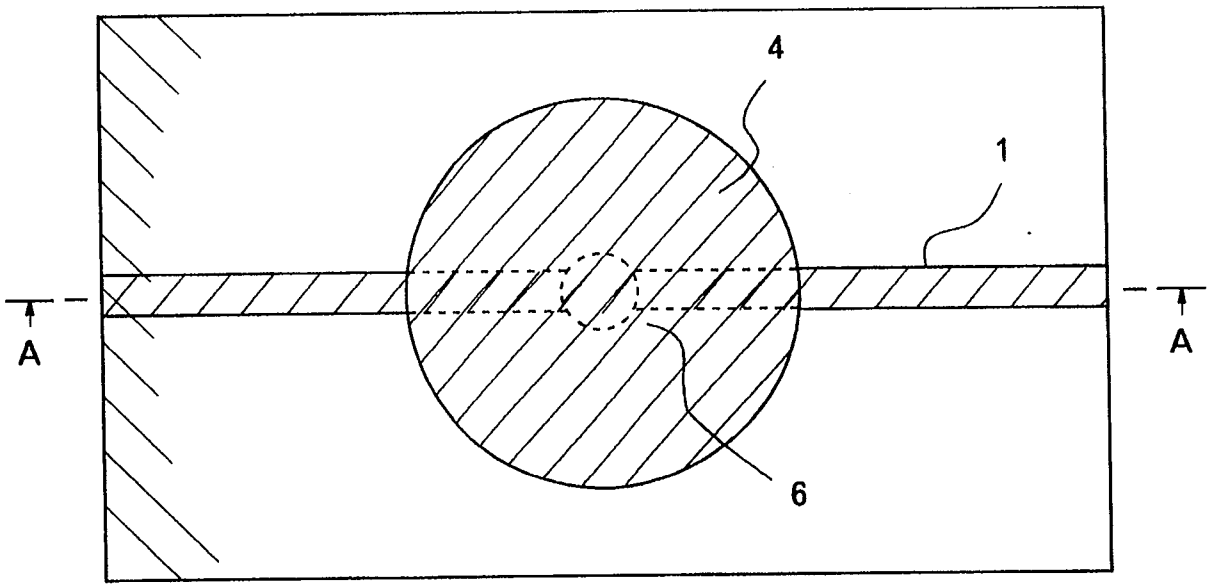
FIG. 3 is a schematic plan view of the choke circuit in FIG. 2.
Figure 4:
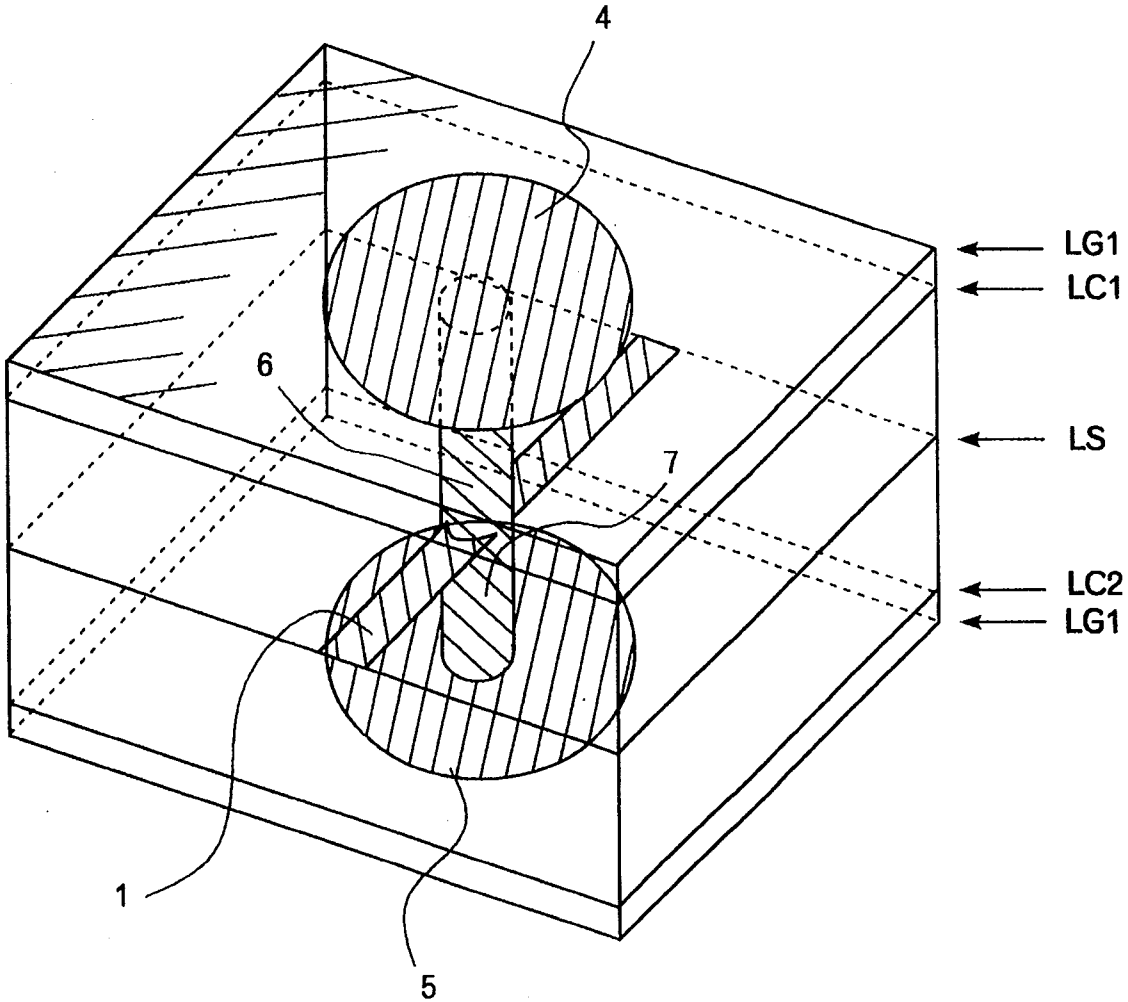
FIG. 4 is a schematic perspective view of the choke circuit in FIG. 2.

FIG. 2 is a schematic sectional view of a high-frequency choke circuit according to an embodiment of the invention. FIG. 3 is a schematic plan view and FIG. 4 a perspective view of the same choke circuit. The sectional view of FIG. 2 is taken along line A—A in FIG. 3. The respective schematic diagrams are for illustrating the configuration, and do not directly represent the actual dimensions and the proportional relationships therebetween.

Multilayered Structure

Referring to FIG. 2, a lead line 1 is interposed between dielectric layers 2 and 3, and capacitance lands 4 and 5 are so formed as to be spaced vertically from the lead line 1 by a prescribed distance. The capacitance lands 4 and 5 are electrically connected to the lead line 1 via through-holes 6 and 7 formed inside dielectric layers 2 and 3.

The respective capacitance lands 4 and 5 are opposed to the grounding conductors 10 and 11 with dielectric layers 8 and 9 interposed in between. Thickness d of the dielectric layers 8 and 9 is made smaller than the thickness of the dielectric layers 2 and 3, so that the capacitance lands 4 and 5 are closer to the grounding conductors 10 and 11 than the lead line 1. Both surfaces of the dielectric layers are covered with the grounding conductors 10 and 11.

In other words, the choke circuit of this embodiment is comprised of a multilayered circuit substrate having what is called a tri-plate structure. That is, the capacitance layers LC1 and LC2 having capacitance lands 4 and 5 thereon are spaced vertically from the central signal layer LS on which the lead line 1 is formed. The lead line 1 is connected to the capacitance lands 4 and 5 via the through-holes 6 and 7 that are respectively formed between signal layer LS and capacitance layers LC1 and LC2.

Further, the grounding layers LG1 and LG2, over which the grounding conductors 10 and 11 are entirely formed, are spaced from capacitance layers LC1 and LC2 by distance d. Since the distance d is smaller than the distance between the signal layer LS and the capacitance layers LC1 and LC2, the capacitance layers LC1 and LC2 are closer to the grounding layers LG1 and LG2 than the signal layer LS. The spaces between layers are filled with a dielectric material.

Lead Line

Formed in the signal layer LS that is located approximately at the center of the dielectric layers, the lead line 1 is a high-impedance line that is necessary for the choke circuit, to enable the passage of a DC bias and refuse that of a high-frequency signal.

Capacitance Lands

The capacitance lands 4 and 5 are respectively opposed to the grounding conductors 10 and 11 with the dielectric layers 8 and 9 of thickness d interposed in between. Thus, the top and bottom capacitors for bypassing a high-frequency wave are provided in parallel.

Figure 5:
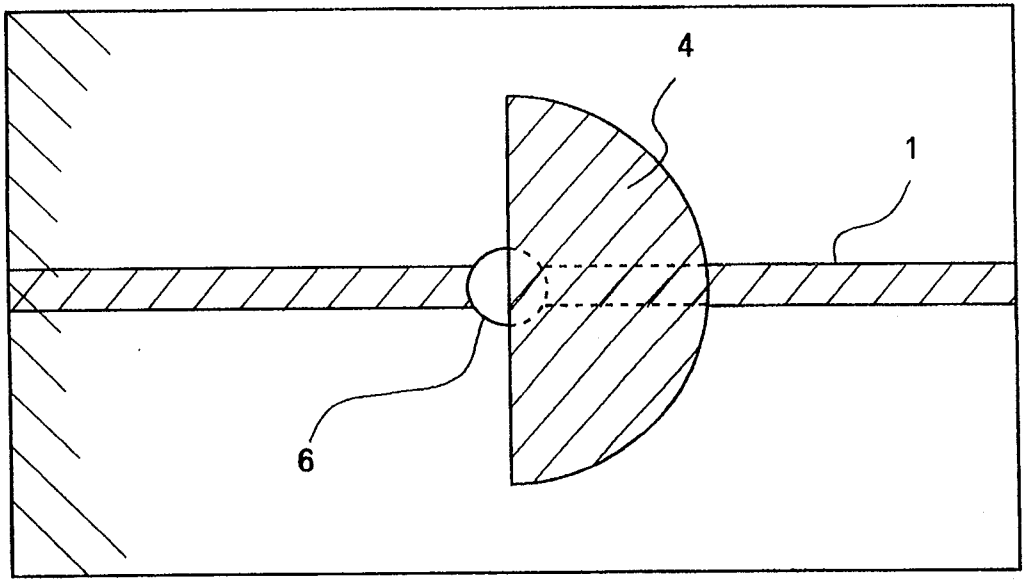
FIG. 5 is a schematic plan view of the choke circuit according to a second embodiment of the present invention.

The capacitance lands 4 and 5 provide a low-impedance line connected to the lead line 1, and are circular in this embodiment as shown in FIGS. 2 and 3. The areas of the capacitance lands 4 and 5 may be set arbitrarily to obtain a required capacity. The shape of the capacitance lands is not limited to a circular one, and they may have a fan shape having a prescribed central angle. As illustrated in FIG. 5, the capacitance can be halved by setting the central angle at 180°. Similarly the capacitance can be reduced to $\frac{1}{3}$ by setting the central angle at 120°.

The interval distance d between the capacitance land 4 and the grounding conductor 10 and between the capacitance land 5 and the grounding conductor 11 is set to $\frac{1}{2}$ or less, preferably $\frac{1}{3}$, of the interval distance between the signal layer LS and the grounding layers LG1 and LG2. If, for example, the interval between the grounding conductors 10 and 11 in the multilayered circuit substrate is 500 $\mu$m, the interval distance d is set at 80 $\mu$m.

Since two parallel high-frequency bypass capacitances are formed by the capacitance lands 4 and 5 and further the capacitance lands 4 and 5 are disposed close to the grounding conductors 10 and 11, a large capacitance can be obtained with a small area. This contributes to a further reduction of the impedance of the low-impedance line.

Further, because the capacitance lands 4 and 5 are formed in the layers that are distant from the signal layer LS, they do not cross, on the same plane, a microwave circuit that is formed on the signal layer LS or a layer close to the signal layer LS. This contributes to the reduction of unnecessary electromagnetic coupling.

Grounding Conductors

Since the grounding conductors 10 and 11 cover both surfaces of the multilayered circuit substrate, they have a shielding function. Therefore, the signal layer LS or an internal circuit that is formed in a layer close to the signal layer LS can be sufficiently isolated electromagnetically from external circuits.

Circuit Characteristics

The above-described circuit that is comprised of the lead line 1, the capacitance lands 4 and 5, and the through-holes 6 and 7 is a low pass filter when viewed from one end of the lead line 1, and provides a superior high-frequency interruption effect. In particular, maximum attenuation is obtained at the resonance frequency of a series resonance circuit comprising the inductances of the through-holes 6 and 7 and the capacitances of the capacitance lands 4 and 5. In addition, by setting the capacitances of the capacitance lands 4 and 5 at another value in the manner described above, a plurality of attenuation poles or a wide interruption band can be easily obtained.

Figure 6:
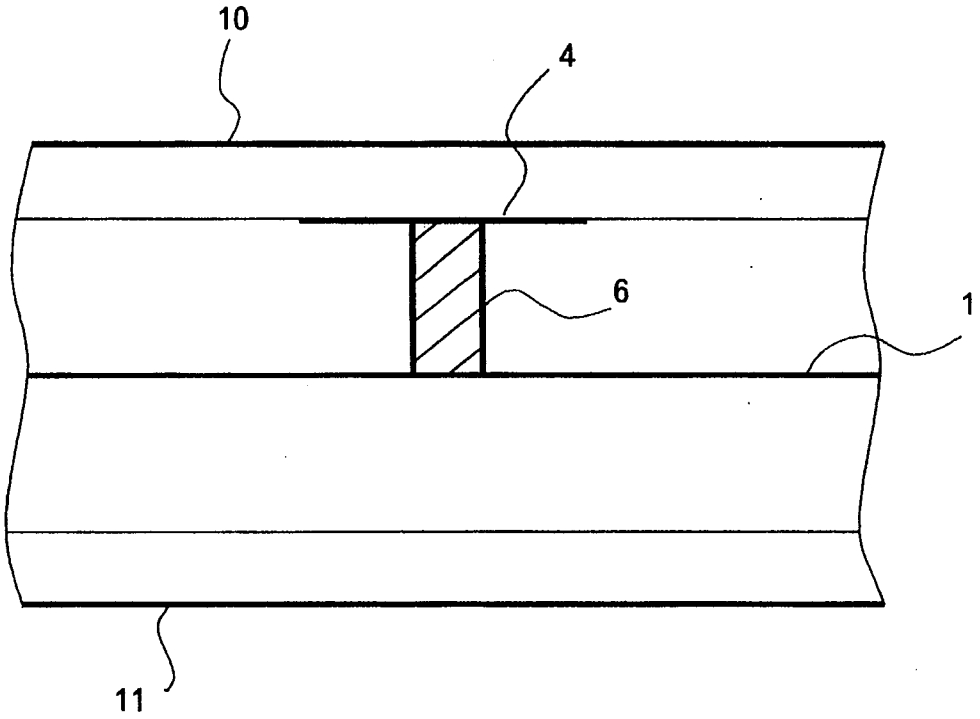
FIG. 6 is a schematic sectional view of a high-frequency choke circuit according to a third embodiment of the present invention.

FIG. 6 is a schematic sectional view of a high-frequency choke circuit according to a third embodiment of the invention. As shown in FIG. 6, a high-frequency choke circuit may be constructed so as to have only one capacitance land 4. This embodiment can also provide, with a simpler circuit configuration, a superior high-frequency interruption effect as in the case of the first embodiment. In addition, since the capacitance land 4 is distant from the lead line 1, i.e., the signal layer LS, unnecessary coupling with a microwave circuit can be minimized as described above.

While the high-frequency choke circuit according to the invention is used as a part of, for instance, a microwave or millimeter wave integrated circuit, it can also be used as a part of, for instance, an EMI (electromagnetic interference) filter. In particular, when used as a part of a composite microwave circuit module, the high-frequency choke circuit of the invention can enable the module to be miniaturized and improve its performance.

As described above in detail, since the lead line is a high-impedance line formed inside the dielectric layers and the capacitance conductors are disposed close to the grounding conductors, the choke circuit of the present invention can provide a low-impedance capacitor having a large capacitance with a small area. As a result, a superior high-frequency interruption effect can be obtained while occupying only a small occupation area.

Since the capacitor constituted of the capacitance conductor is formed on a different layer distant from the central layer on which the lead line is formed, it does not cross, on the same plane, microwave or millimeter wave circuits that are formed on the center layer or a layer close to the center layer. Therefore, unnecessary electromagnetic coupling can be prevented and the circuit operation can be stabilized. Further, because capacitance patterns and interconnection patterns are formed in a multilayer structure, the entire circuit can be miniaturized.

Since the grounding conductors enclose the dielectric layers that incorporate the capacitance conductors and the lead line, the circuit formed on the dielectric layers can be shielded electromagnetically from outside. In particular, because it is capable of preventing radiation from the internal circuit toward the outside, the high-frequency choke circuit of the invention is suitable for use in a microwave circuit, for instance.

What is claimed is:

1. A high-frequency choke circuit for interrupting a high-frequency component, comprising:

grounding conductors formed on both surfaces of a dielectric layer;

a lead line formed within the dielectric layer;

capacitance means disposed in the dielectric layer and opposed to at least one of the grounding conductors, the capacitance means being closer to the grounding conductor than to the lead line; and connection means for electrically connecting the lead line and the capacitance means, the connection means being formed in the dielectric layer.

2. The high-frequency choke circuit according to claim 1, wherein the capacitance means comprises first and second capacitance conductors opposed to the respective grounding conductors.

3. The high-frequency choke circuit according to claim 2, wherein the connection means comprises first and second through-holes respectively connecting the first and second capacitance conductors to the lead line.

4. The high-frequency choke circuit according to claim 1, wherein the capacitance means comprises a capacitance conductor opposed to one of the grounding conductors.

5. The high-frequency choke circuit according to claim 4, wherein the connection means comprises a through-hole connecting the capacitance conductor to the lead line.

6. The high-frequency choke circuit according to claim 1, wherein a distance between one of the grounding conductors and the capacitance means opposed to the grounding conductor is $\frac{1}{3}$ or smaller than the distance between the lead line and the grounding conductor.

7. The high-frequency choke circuit according to claim 2, wherein a distance between one of the grounding conductors and the capacitance conductor opposed to the grounding conductor is $\frac{1}{3}$ or smaller than the distance between the lead line and the grounding conductor.

8. The high-frequency choke circuit according to claim 4, wherein a distance between the grounding conductor and the capacitance conductor opposed to the grounding conductor is $\frac{1}{3}$ or smaller than the distance between the lead line and the grounding conductor.

9. The high-frequency choke circuit according to claim 5, wherein a distance between the grounding conductor and the capacitance conductor opposed to the grounding conductor is $\frac{1}{3}$ or smaller than the distance between the lead line and the grounding conductor.

10. A high-frequency choke circuit formed in a dielectric multilayered structure, comprising:

grounding conductor layers covering both surfaces of a dielectric layer;

a signal layer located at the center of the dielectric layer, the signal layer having at least a high-impedance line formed thereon;

at least one capacitance conductor layer formed within the dielectric layer, the capacitance conductor layer being opposed to one of the grounding conductor layers and disposed at a position more distant from the signal layer than from the grounding conductor layer; and at least one interconnection conductor formed in the dielectric layer to connect the high-impedance line and at least one capacitance conductor layer.

11. The high-frequency choke circuit according to claim 10, wherein at least one capacitance conductor layer comprises top and bottom capacitance conductor layers that are opposed to the respective grounding conductor layers.

12. The high-frequency choke circuit according to claim 11, wherein at least one interconnection conductor layer comprises top and bottom through-holes connecting the high-impedance line and the top and bottom capacitance conductor layers, respectively.

13. The high-frequency choke circuit according to claim 10, wherein at least one capacitance conductor layer comprises one capacitance conductor layer opposed to one of the grounding conductors.

14. The high-frequency choke circuit according to claim 13, wherein at least one interconnection conductor layer comprises a through-hole connecting the high-impedance line and the capacitance conductor layer.

15. The high-frequency choke circuit according to claim 10, wherein a distance between one of the grounding conductor layers and the capacitance conductor layer opposed to the grounding conductor layer is $\frac{1}{3}$ or smaller than the distance between the signal layer and the grounding conductor layer.

16. The high-frequency choke circuit according to claim 13, wherein a distance between one of the grounding conductor layers and the capacitance conductor layer opposed to the grounding conductor layer is $\frac{1}{3}$ or smaller than the distance between the signal layer and the grounding conductor layer.

17. The high-frequency choke circuit according to claim 14, wherein a distance between one of the grounding conductor layers and the capacitance conductor layer opposed to the grounding conductor layer is $\frac{1}{3}$ or smaller than the distance between the signal layer and the grounding conductor layer.

* * * * *